US007456580B2

(12) United States Patent
Han et al.

(10) Patent No.: US 7,456,580 B2
(45) Date of Patent: Nov. 25, 2008

(54) LIGHT EMITTING DEVICE

(75) Inventors: Chang Wook Han, Anyang-si (KR); Sung Joon Bae, Seongnam-si (KR)

(73) Assignee: LG Display Co., Ltd., Seoul (KR)

( * ) Notice: Subject to any disclaimer, the term of this patent is extended or adjusted under 35 U.S.C. 154(b) by 333 days.

(21) Appl. No.: 11/477,794

(22) Filed: Jun. 30, 2006

(65) Prior Publication Data

US 2007/0296671 A1 Dec. 27, 2007

(30) Foreign Application Priority Data

Jun. 30, 2005 (KR) ..... 10-2005-0058878
Jun. 23, 2006 (KR) ..... 10-2006-0056798

(51) Int. Cl.
*G09G 3/10* (2006.01)

(52) U.S. Cl. ..... 315/169.3; 345/76; 345/77

(58) Field of Classification Search ..... 315/169.1, 315/169.3; 345/55, 76, 77, 80, 82, 83
See application file for complete search history.

(56) References Cited

U.S. PATENT DOCUMENTS 6,677,713 B1 * 1/2004 Sung ..... 315/169.1
7,193,588 B2 * 3/2007 Lo ..... 345/76
7,221,349 B2 * 5/2007 Hashido et al. ..... 345/89
7,277,073 B2 * 10/2007 Hattori ..... 345/77

* cited by examiner

*Primary Examiner*—Douglas W. Owens
*Assistant Examiner*—Jimmy T Vu
(74) *Attorney, Agent, or Firm*—McKenna Long & Aldridge LLP

(57) ABSTRACT

Provided is a light emitting device. Particularly, the light emitting device comprises a threshold voltage compensator. The threshold voltage compensator is connected between a gate and a drain of the driving TFT and has a gate connected to a second scan line to temporarily store at the storage capacitor a gate voltage reflecting a threshold voltage of the driving TFT in response to a second scan signal supplied by a second scan line and to transmit the data signal regardless of variations in the threshold voltage of the driving TFT when the output current is supplied to the light emitting diode.

19 Claims, 10 Drawing Sheets

LIGHT EMITTING DEVICE

This application claims the benefit of Korean Patent Applications Nos. 10-2005-0058878 and 10-2006-0056798, filed on Jun. 30, 2005 and Jun. 23, 2006, which are hereby incorporated by reference for all purposes as if fully set forth herein.

BACKGROUND OF THE INVENTION

1. Field of the Invention

The present invention relates to a light emitting device.

2. Discussion of the Background Art

An organic light emitting device, which is also called an organic light emitting diode (OLED), is a self-luminous device that causes a fluorescent material to emit light when electron-hole pairs are generated. Self-luminous light emitting devices have a faster response rate and a lower direct current driving voltage than passive light emitting devices such as liquid crystal displays requiring a separate light source and can be implemented using a very thin film. These advantages allow organic light emitting displays to be implemented in various configurations such as a wall mount type and a portable type.

An organic light emitting device implements colors using pixels in which sub-pixels of red, blue and green produce one color. According to driving types of sub-pixels, an organic light emitting device may be classified as a passive matrix OLED (PMOLED) that is a simple matrix and an active matrix OLED (AMOLED) that uses a thin film transistor to drive the device.

Various AMOLED driving methods have been used such as a current based driving method, a voltage based driving method and a digital driving method.

FIG. 1 illustrates an equivalent circuit diagram of an AMOLED 10 pixel based on a typical current based driving method. The AMOLED 10 is configured in a 2T1C structure including two TFTs and one capacitor. Particularly, the two TFTs are a driving TFT and a switching TFT denoted as DT and ST in FIG. 1, and the capacitor is a storage capacitor denoted as Cst in FIG. 1. The driving TFT DT and the switching TFT ST are N-channel metal oxide semiconductor (NMOS) transistors.

The AMOLED 10 includes an OLED in which an organic emissive layer is formed between charge transport layers. The OLED is connected between a supply voltage VDD and the driving TFT DT. The OLED emits light corresponding to an amount of output current $I_{OLED}$ supplied from the driving TFT DT.

The driving TFT DT is connected between the OLED and a ground voltage GND, and a gate of the driving TFT DT is connected with one end of the storage capacitor Cst. The driving TFT DT supplies the output current $I_{OLED}$ to the OLED.

The switching TFT ST is connected between the gate of the driving TFT DT and a data line 12, and a gate of the switching TFT ST is connected with a scan line 14. Therefore, when a scan signal is supplied to the gate of the switching TFT DT through the scan line 14, the switching TFT ST turns on to supply a data signal to the gate of the driving TFT DT. As a result, the data signal is stored into the storage capacitor Cst.

The storage capacitor Cst stores the data signal switched by the switching TFT ST, and this stored data signal allows the driving TFT DT to retain an 'on' state even if the switching TFT ST turns off by disablement of the scan signal.

The typical AMOLED 10 stores the data signal on the storage capacitor Cst and drives the driving TFT DT in response to the stored data signal to make the OLED emit light using the output current $I_{OLED}$ corresponding to the data signal.

The typical AMOLED 10 may degrade due to various factors because the AMOLED 10 uses the driving TFT DT. Hence, as illustrated in FIG. 2, the driving TFT DT has a current-voltage characteristic curve shifted to the right. As a result, a threshold voltage Vth generally increases. For instance, the threshold voltage Vth may increase from 2 V to 2.5 V.

As the threshold voltage Vth increases, the output current $I_{OLED}$ of the driving TFT DT of the typical AMOLED 10 decreases. Particularly, the decrease in the output current $I_{OLED}$ generally reduces the brightness of the OLED. The below mathematical equation shows the above described relationship between the threshold voltage Vth and the output current $I_{OLED}$.

$$I_{OLED} = \frac{\beta}{2}(Vgs - Vth)^2 \qquad \text{Eq. 1}$$

Herein, $I_{OLED}$, β, Vgs, and Vth represent an output current of the driving TFT DT, a constant of the driving TFT DT, a voltage between a source and a gate of the driving TFT DT, and a threshold voltage of the driving TFT DT, respectively.

In the typical AMOLED 10, brightness of the OLED may decrease due to the increase in the threshold voltage Vth. Thus, organic light emitting displays comprising typical AMOLEDs may have a shortened durability.

SUMMARY OF THE INVENTION

Accordingly, the present invention is directed to a light emitting device that substantially obviates one or more of the problems due to limitations and disadvantages of the related art.

An advantage of the present invention is to overcome at least the problems and disadvantages of the related art.

Embodiments of the present invention are directed to a light emitting device that improves brightness even if a driving TFT is degraded by compensating a threshold voltage of the driving TFT.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purposes of the present invention, as embodied and broadly described, a light emitting device includes: a light emitting diode emitting light due to an output current; a storage capacitor storing a data signal supplied by a data line; a driving thin film transistor (TFT) connected between a supply voltage and the light emitting diode and having a gate connected to one end of the storage capacitor to supply the output current to the light emitting diode using the data signal stored in the storage capacitor; an input switch connected between the one end of the storage capacitor and the data line and having a gate connected to a first scan line to transmit the data signal supplied by the data line in response to a first scan signal supplied by the first scan line; and a threshold voltage compensator connected between the gate and a drain of the driving TFT and having a gate connected to a second scan line to temporarily store at the storage capacitor a gate voltage reflecting a threshold voltage of the driving TFT in response to a second scan signal supplied by the second scan line and to transmit the data signal regardless of variations in the threshold voltage of the driving TFT when the output current is supplied to the light emitting diode.

In another aspect of the present invention, a light emitting device includes: a light emitting diode emitting light due to an output current; a storage capacitor storing a data signal supplied by a data line; a driving thin film transistor (TFT) connected between a ground voltage and the light emitting diode and having a gate connected to one end of the storage capacitor to supply the output current to the light emitting diode using the data signal stored in the storage capacitor; an input switch connected between the gate of the driving TFT and the data line and having a gate connected to a first scan line to transmit the data signal supplied by the data line in response to a first scan signal supplied by the first scan line; and a threshold voltage compensator connected between the gate and a drain of the driving TFT and having a gate connected to a second scan line to temporarily store at the storage capacitor a gate voltage reflecting a threshold voltage of the driving TFT in response to a second scan signal supplied by the second scan line and to transmit the data signal regardless of variations in the threshold voltage of the driving TFT when the output current is supplied to the light emitting diode.

In still another aspect of the present invention, the light emitting device may further include a threshold voltage restorer connected to a gate of a driving TFT and restoring a threshold voltage using a negative bias voltage generated by supplying a gate voltage lower than a ground voltage.

Accordingly, the light emitting device according to various exemplary embodiments of the present invention can reduce the power consumption and thus, provide a longer durability.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF ILLUSTRATED EMBODIMENTS

Reference will now be made in detail to an embodiment of the present invention, example of which is illustrated in the accompanying drawings.

Figure 1:
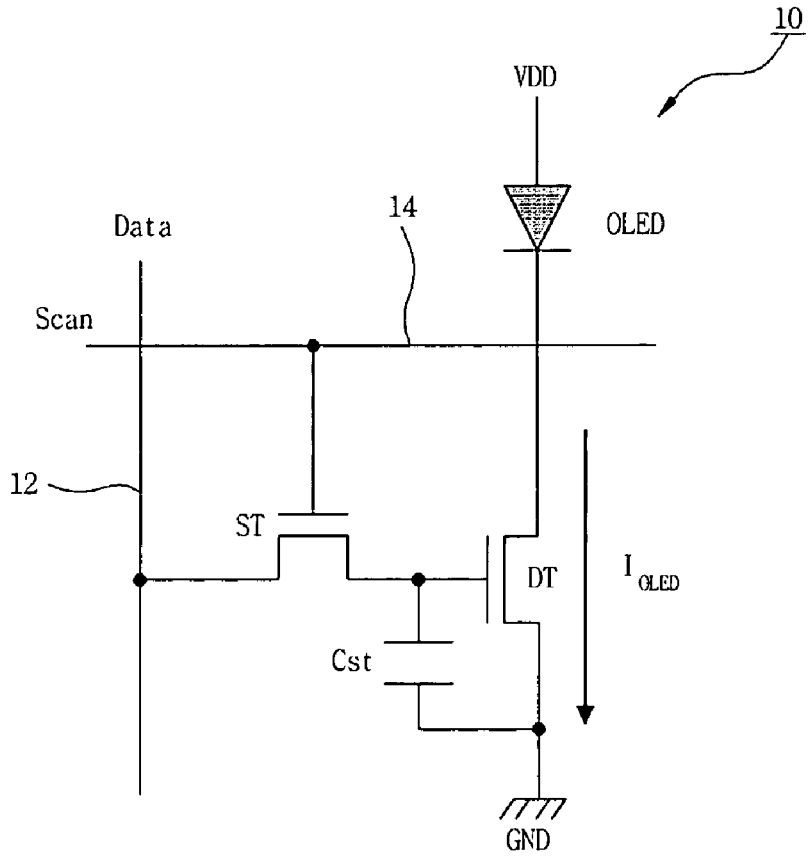
FIG. 1 illustrates an equivalent circuit diagram of a typical AMOLED.
Figure 2:
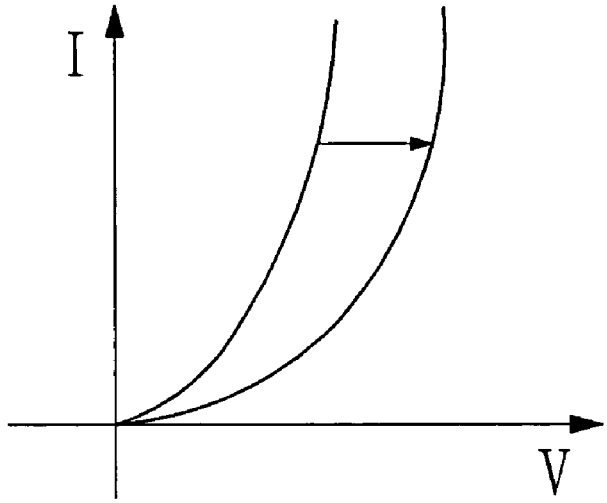
FIG. 2 is a graph illustrating a change in a voltage-current characteristic caused by a degraded driving TFT of a typical AMOLED.
Figure 3:
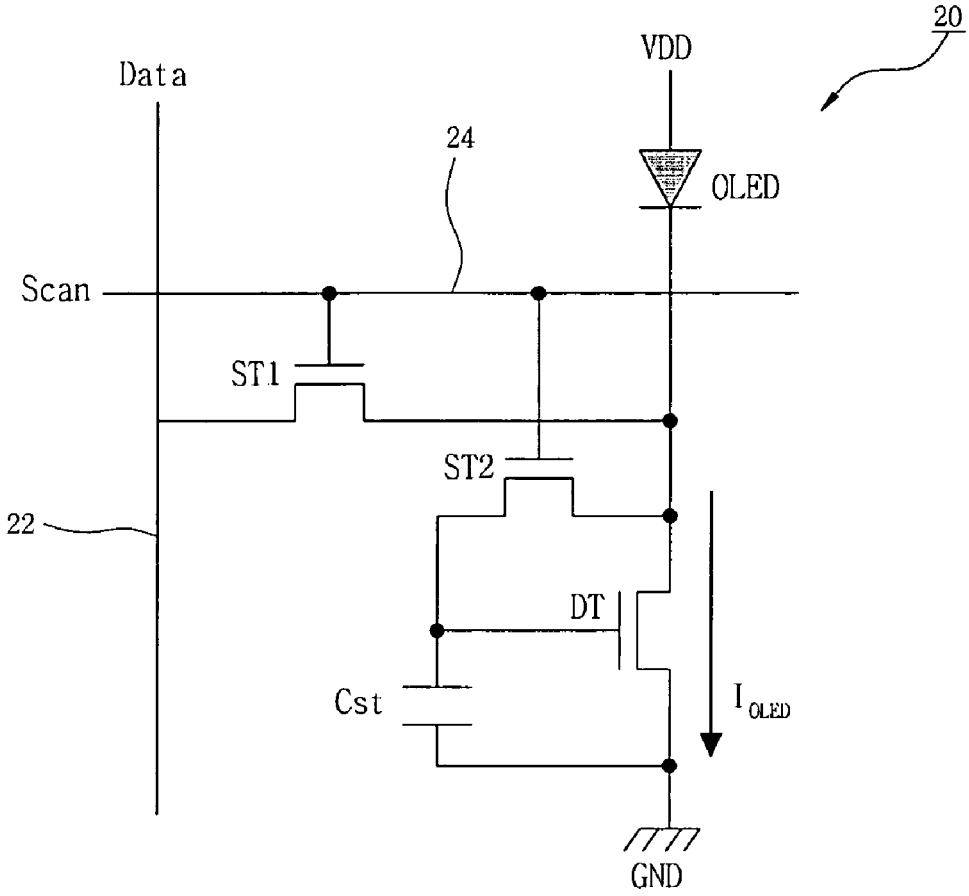
FIG. 3 illustrates an equivalent circuit diagram of an organic light emitting device in accordance with a first embodiment of the present invention.

FIG. 3 illustrates an equivalent circuit diagram of an organic light emitting device in accordance with a first embodiment of the present invention. Particularly, the organic light emitting device is an AMOLED.

As illustrated, the AMOLED 20 includes a driving TFT denoted as DT, first and second switching TFTs denoted as ST1 and ST2, a storage capacitor Cst, and an OLED.

The driving TFT DT and the first and second switching TFTs ST1 and ST2 are NMOS transistors. The second switching TFT ST2 is a threshold voltage compensator compensating a threshold voltage.

The OLED includes an organic emissive layer formed between charge transport layers and emits light by coupled electron-hole pairs. The OLED is connected between a supply voltage VDD and the driving TFT DT.

The OLED emits light corresponding to an amount of an output current $I_{OLED}$ supplied from the driving TFT DT. The OLED may be formed of various materials and configured in a stacked structure. However, detailed description thereof will be omitted.

The driving TFT DT is connected between the OLED and a ground voltage GND, and a gate of the driving TFT DT is connected with one end of the storage capacitor Cst.

The driving TFT DT is a driving transistor supplying the output current $I_{OLED}$ to the OLED.

Particularly, the second switching TFT ST2 is connected between the gate and a drain of the driving TFT DT. Thus, when the second switching TFT ST2 is turned on, the driving TFT DT exhibits substantially the same operation characteristics as the OLED. As a result, a threshold voltage Vth of the driving TFT DT can be stored on the storage capacitor Cst.

The first switching TFT ST1 is connected between the drain of the driving TFT DT and a data line 22, and a gate of the first switching TFT ST1 is connected with a scan line 24. Therefore, when a scan signal is supplied to the gate of the first switching TFT ST1 through the scan line 24, the first switching TFT ST1 is turned on and then, a data signal is supplied to the drain of the driving TFT DT to thereby store the data signal into the storage capacitor Cst along with the aforementioned threshold voltage of the driving TFT DT.

The second switching TFT ST2 functions as the threshold voltage compensator, and as described above, is connected between the drain and the gate of the driving TFT DT. A gate of the second switching TFT ST2 is connected with the scan line 24.

When the second switching TFT ST2 is turned on by the scan signal supplied through the scan line 24, the second switching TFT ST2 stores the data signal switched by the first switching TFT ST1 and the threshold voltage Vth of the driving TFT DT on the storage capacitor Cst.

The storage capacitor Cst stores the data signal switched by the first switching TFT ST1 and a gate voltage reflecting the threshold voltage Vth of the driving TFT DT and drives the driving TFT DT based on the stored data signal and threshold voltage Vth even if the first and second switching TFTs ST1 and ST2 are turned off when the scan signal is disabled.

The driving TFT DT compensates for a threshold voltage Vth, defined by the aforementioned mathematical equation, based on the stored threshold voltage Vth in the storage capacitor Cst. Thus, the driving TFT DT supplies a certain level of the output current $I_{OLED}$ to the OLED regardless of the threshold voltage Vth.

Figure 4:
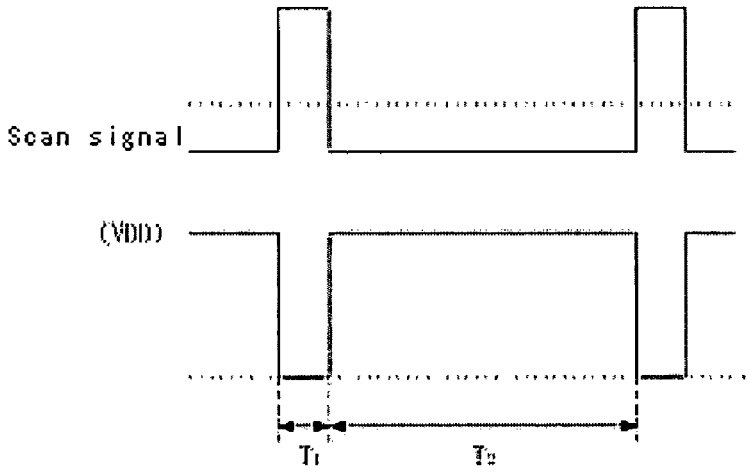
FIG. 4 is a drive timing diagram of the organic light emitting device illustrated in FIG. 3.
Figure 5:
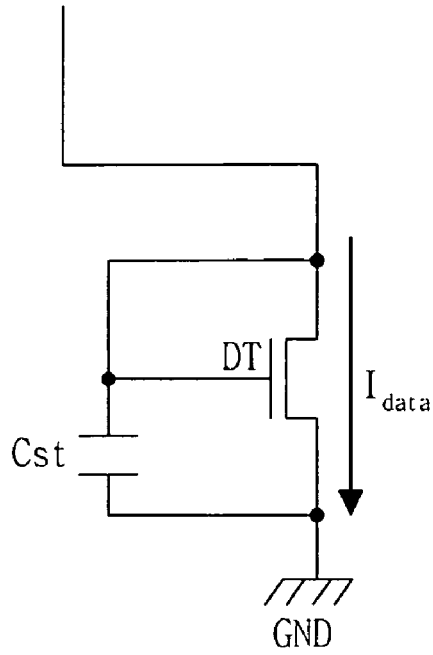
FIG. 5 illustrates an equivalent circuit diagram when a current programming operation is performed during an interval T1 illustrated in FIG. 3.
Figure 6:
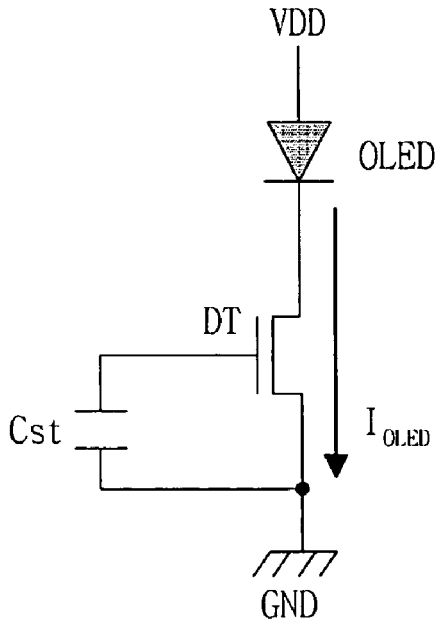
FIG. 6 illustrates an equivalent circuit diagram when an output current is supplied during an interval T2 illustrated in FIG. 3.

Thus, even if the driving TFT DT is degraded by the compensation of the threshold voltage Vth of the driving TFT DT, the brightness of the AMOLED 20 is not lowered. With reference to FIGS. 4 to 6, operation of the AMOLED 20 according to the first embodiment of the present invention will be described.

FIG. 4 is a drive timing diagram of the AMOLED 20 illustrated in FIG. 3. FIG. 5 illustrates an equivalent circuit diagram when a current programming operation is performed during an interval T1 illustrated in FIG. 4. FIG. 6 illustrates an equivalent circuit diagram when the output current is supplied during an interval T2 illustrated in FIG. 4.

Referring to FIG. 4, in the AMOLED 20 according to the first embodiment of the present invention, the supply voltage VDD is disabled when the scan signal is supplied through the scan line 24. This operation corresponds to the current programming interval T1. On the contrary, the supply voltage VDD is supplied when the scan signal is disabled. This operation corresponds to the output current supply interval T2.

The supply voltage VDD is switched by an external switch connected between the AMOLED 20 and a power supply terminal (not shown) outside a panel where the AMOLED 20 is formed. That is, the scan signal is supplied when a control signal synchronized with the scan signal is supplied to the external switch, and in response to the scan signal, the supply voltage turns off. In contrast, when the scan signal is disabled, the supply voltage is supplied.

Referring to FIG. 5, during the current programming interval T1, the scan signal is supplied to the gates of the first and second switching TFTs ST1 and ST2 through the scan line 24, and the supply voltage VDD is not supplied. When the first and second switching TFTs ST1 and ST2 turn on due to the scan signal, the data signal, i.e., the data current $I_{data}$, is supplied to the driving TFT DT through the data line 22 to drive the driving TFT DT.

Because the gate and the drain of the driving TFT DT are connected together, the driving TFT DT exhibits substantially the same operation characteristics as the OLED, a voltage by the data current $I_{data}$ and the threshold voltage Vth of the driving TFT DT are stored into the storage capacitor Cst connected with the gate of the driving TFT DT.

Referring to FIG. 6, during the output current supply interval T2, the scan signal is disabled, and the supply voltage VDD is supplied. Thus, the voltage by the data current $I_{data}$ stored in the storage capacitor Cst drives the driving TFT DT to thereby supply the output current $I_{OLED}$ to the OLED.

At this time, due to the threshold voltage Vth stored in the storage capacitor Cst, the output current $I_{OLED}$ has a value independent of the threshold voltage compensated based on the aforementioned mathematical equation.

As a result, even if the threshold voltage Vth increases due to the degradation of the driving TFT DT, a certain level of the output current $I_{OLED}$ is retained. Hence, the OLED can retain a certain level of brightness.

Figure 7:
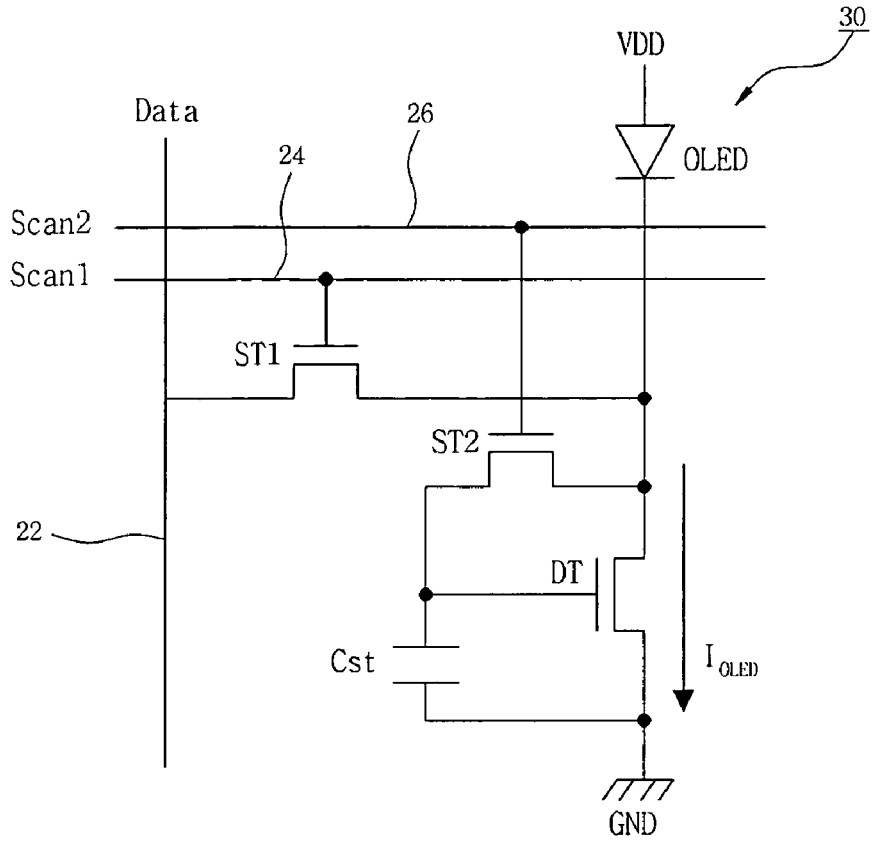
FIG. 7 illustrates an equivalent circuit diagram of an organic light emitting device in accordance with a second embodiment of the present invention.
Figure 8:
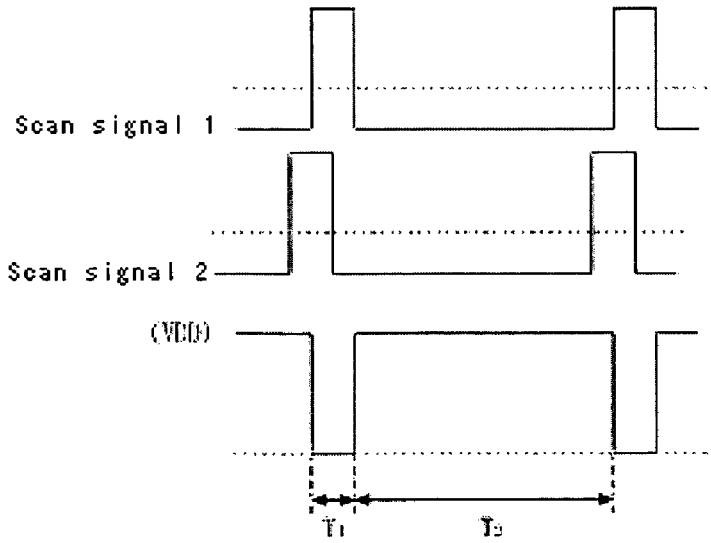
FIG. 8 is a drive timing diagram of the organic light emitting device illustrated in FIG. 7.

FIG. 7 illustrates an equivalent circuit diagram of an organic light emitting device in accordance with a second embodiment of the present invention. FIG. 8 is a drive timing diagram of the organic light emitting device illustrated in FIG. 7.

Referring to FIGS. 7 and 8, the organic light emitting device 30 has substantially the same configuration of the AMOLED 20 except that different scan signals are supplied to the gates of the first switching TFT ST1 and the second switching TFT ST2 through respective scan lines 24 and 26.

Even if the different scan signals are supplied to the gates of the first switching TFT ST1 and the second switching TFT ST2 through the two respective scan lines 24 and 26, the supply voltage is not supplied when the scan signals are supplied as identical to the first embodiment of the present invention.

Figure 9:
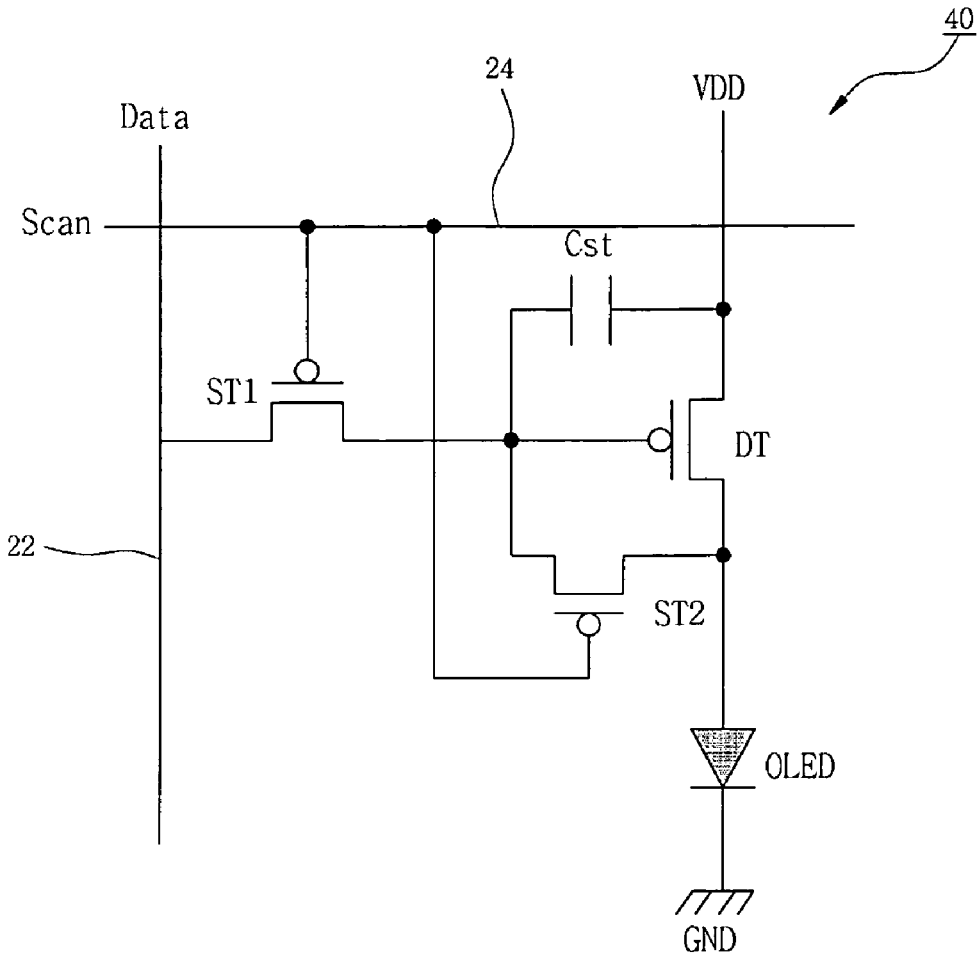
FIG. 9 illustrates an equivalent circuit diagram of an organic light emitting device in accordance with a third embodiment of the present invention.
Figure 10:
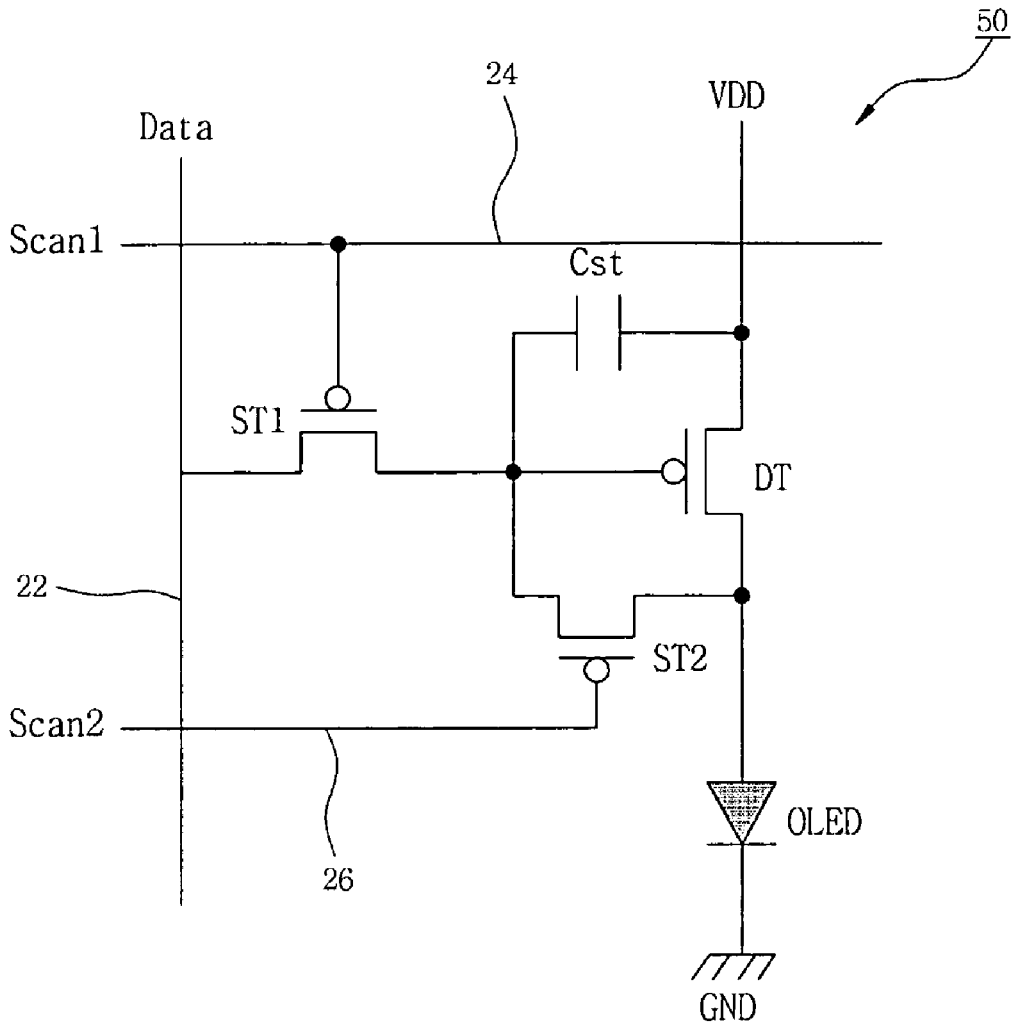
FIG. 10 illustrates an equivalent circuit diagram of an organic light emitting device in accordance with a fourth embodiment of the present invention.

FIG. 9 illustrates an equivalent circuit diagram of an organic light emitting device in accordance with a third embodiment of the present invention. FIG. 10 is an equivalent circuit diagram of an organic light emitting device in accordance with a fourth embodiment of the present invention.

The organic light emitting devices 40 and 50 respectively according to the third and fourth embodiments of the present invention are different from the organic light emitting devices 20 and 30 respectively according to the first and second embodiments of the present invention in that the driving TFT DT and the first and second switching TFTs ST1 and ST2 are P-channel metal oxide semiconductor (PMOS) transistors.

However, the driving TFT DT, the first and second TFTs ST1 and ST2 and the storage capacitor Cst have substantially the same functions.

To have the same functionality of the organic light emitting devices 20 and 30 comprising NMOS transistors, the OLED of each of the organic light emitting devices 40 and 50 is connected between the driving TFT DT and the ground voltage GND, the storage capacitor Cst is connected between the source and the gate of the driving TFT DT, and the second switching TFT ST2 is connected between the gate and the drain of the driving TFT DT.

There is a difference between the organic light emitting devices 40 and 50 in that the gates of the first and second switching TFTs ST1 and ST2 are individually connected with the same scan line 24 or with the two different scan lines 24 and 26. However, the organic light emitting devices 40 and 50 perform substantially the same operations.

As described in the above embodiments of the present invention, the light emitting devices are organic light emitting devices comprising organic emissive layers.

In the organic light emitting devices according to the above embodiments of the present invention, the data signal supplied to the data line is a static current and drives the driving TFT when the first scan signal and the second scan signal become an 'on' state.

More specifically, when the first scan signal and the second scan signal are turned on, the data signal is supplied through the data line to the driving TFT based on a source driving method using a setting current that is set to reflect the static current as the threshold voltage. Hence, even if the threshold voltage increases due to the degradation of the driving TFT, the OLED can emit light with an intended level of brightness.

Figure 11:
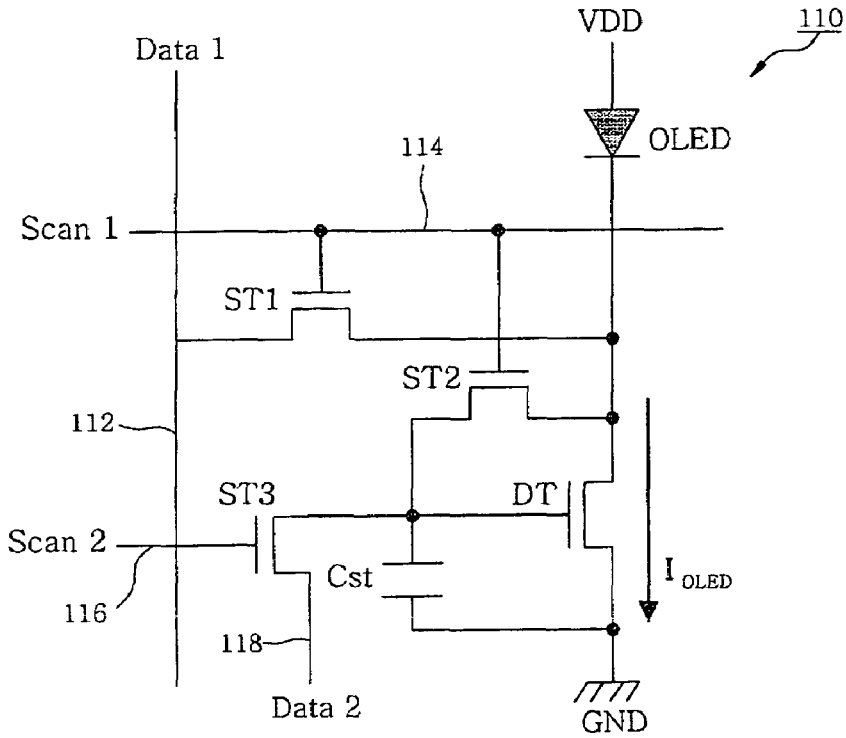
FIG. 11 illustrates an equivalent circuit diagram of an organic light emitting device in accordance with a fifth embodiment of the present invention.
Figure 12:
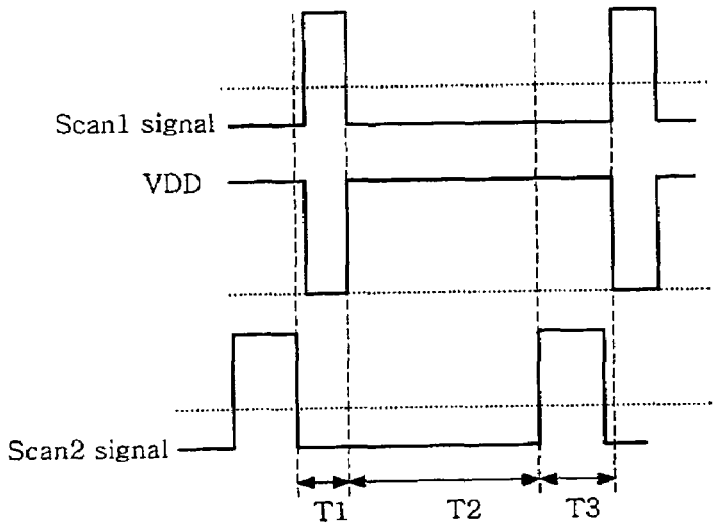
FIG. 12 illustrates a drive timing diagram of the organic light emitting device illustrated in FIG. 11.

FIG. 11 illustrates an equivalent circuit diagram of an organic light emitting device in accordance with a fifth embodiment of the present invention. FIG. 12 illustrates a drive timing diagram of the organic light emitting device illustrated in FIG. 11.

Referring to FIGS. 11 and 12, the organic light emitting device 110 includes a driving TFT DT, first and second switching TFTs ST1 and ST2, a storage capacitor Cst, an OLED, and a threshold voltage restorer ST3.

The driving TFT DT, the first and second switching transistors ST1 and ST2, the storage capacitor Cst, and the OLED have substantially the same functionality and operation as the driving TFT DT, the first and second switching transistors ST1 and ST2, the storage capacitor Cst, and the OLED of the organic light emitting device 20 according to the first embodiment of the present invention. Hence, a detailed description thereof will be omitted.

The threshold voltage restorer ST3 is connected between a gate of the driving TFT DT and a supporting data line 118, and a gate of the threshold voltage restorer ST3 is connected to a supporting scan line 116. Therefore, the threshold voltage restorer ST3 turns on when a supporting scan signal is supplied to the gate of the threshold voltage restorer ST3 by the supporting scan line 116. The threshold voltage restorer ST3 may be an NMOS transistor, but is not limited to this illustrative implementation.

As described above, the threshold voltage restorer ST3 is connected to the gate of the driving TFT DT and supplies a gate voltage that is lower than a ground voltage $GND_n$ thereby generating a negative bias voltage. The threshold voltage restorer ST3 restores a threshold voltage Vth of the driving TFT DT using this negative bias voltage.

Therefore, a certain level of brightness may be obtained without increasing a supply voltage VDD. As a result, the power consumption may be reduced.

Figure 13:
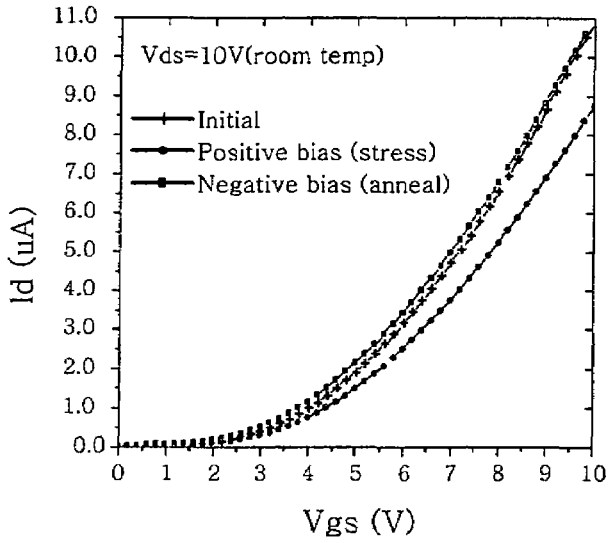
FIG. 13 is a graph illustrating a change in a voltage-current characteristic due to a restored threshold voltage of a driving TFT of the organic light emitting device in accordance with the fifth embodiment of the present invention.

With reference to FIGS. 12 and 13, operation of the organic light emitting device according to the fifth embodiment will be described in detail below.

FIG. 13 is a graph illustrating a voltage-current characteristic of the driving TFT DT of the organic light emitting device 110 according to the fifth embodiment of the present invention.

Referring to FIG. 12, the organic light emitting device 110 operates similar to the organic light emitting device 20 according to the first embodiment. More specifically, when a scan signal Scan1 Signal is supplied by a scan line 114 (i.e., during a current programming interval T1), the supply voltage VDD is not supplied. In contrast, when the scan signal Scan1 Signal is not supplied (i.e., during an output current supply interval T2), the supply voltage VDD is supplied.

In the organic light emitting device 110 according to the fifth embodiment of the present invention, a supporting scan signal Scan2 Signal is supplied to the gate of the threshold voltage restorer ST3 by the supporting scan line 116. When the threshold voltage restorer ST3 turns on due to the supporting scan signal Scan2 Signal, a supporting data signal, i.e., a gate voltage lower than the ground voltage $GND_n$, is supplied by the supporting data line 118.

As a result, as illustrated in FIG. 13, the curve for the voltage-current characteristic of the driving TFT DT is shifted to the left. This shift means that the threshold voltage Vth is restored.

Accordingly, even if the threshold voltage Vth increases due to the degradation of the driving TFT DT, the negative bias voltage supplied by the threshold voltage restorer ST3 compensates the variation of the threshold voltage Vth. Thus, the increased threshold voltage Vth level may be restored to the previous level.

Figure 14:
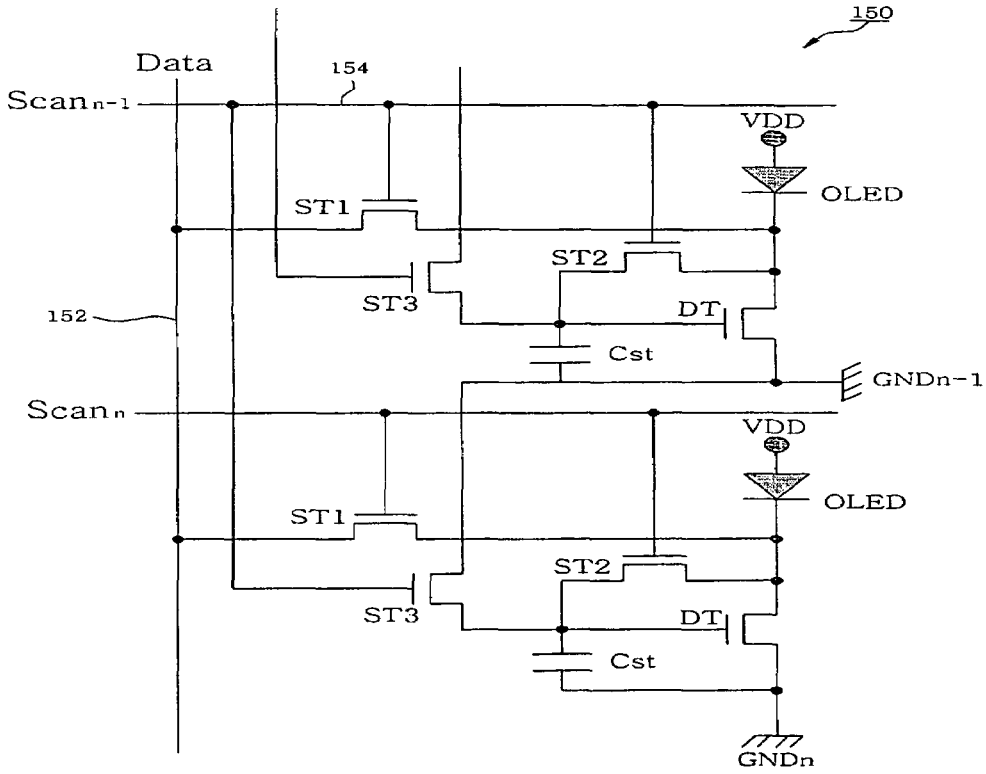
FIG. 14 illustrates an equivalent circuit diagram of an organic light emitting device in accordance with a sixth embodiment of the present invention.
Figure 15:
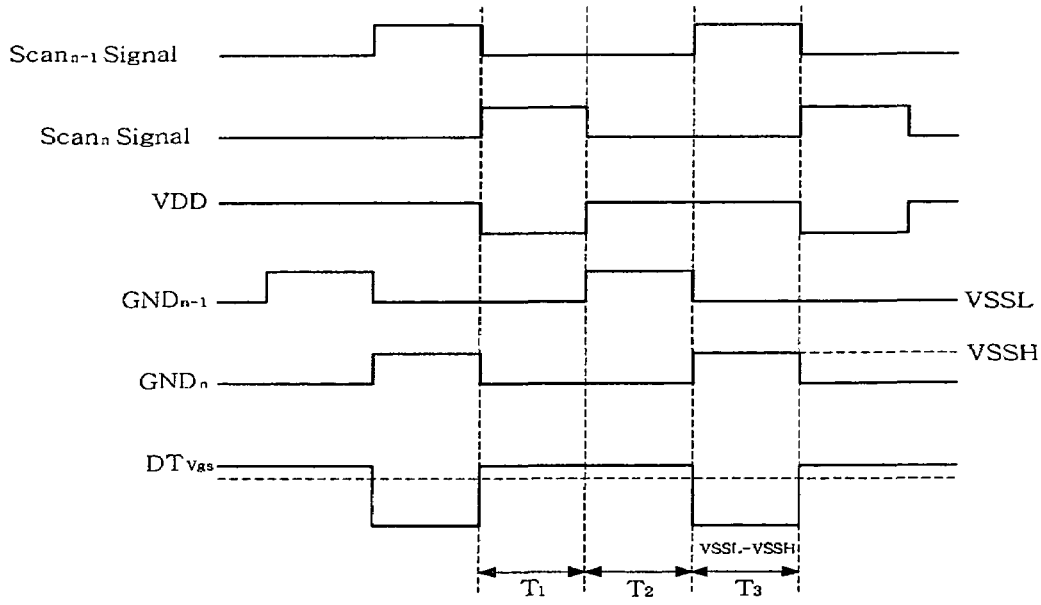
FIG. 15 illustrates a drive timing diagram of the organic light emitting device illustrated in FIG. 14.

FIG. 14 illustrates an equivalent circuit diagram of an organic light emitting device in accordance with a sixth embodiment of the present invention. FIG. 15 illustrates a drive timing diagram of the organic light emitting device illustrated in FIG. 14.

With reference to FIGS. 14 and 15, as in the organic light emitting device 110 according to the fifth embodiment, the organic light emitting device 150 in the present embodiment includes a driving TFT DT, first and second switching transistors ST1 and ST2, a storage capacitor Cst, an OLED, and a threshold voltage restorer ST3.

The threshold voltage restorer ST3 is connected between a gate of the driving TFT DT and a ground voltage $GND_{n-1}$ of a previous terminal (hereinafter referred to as "previous ground voltage").

Particularly, a gate of the threshold voltage restorer ST3 is connected to a scan line 154 of the previous terminal (hereinafter referred to as "previous scan line" and labeled also as $Scan_{n-1}$), so that a previous scan signal that is supplied by the previous scan line 154 allows the driving TFT DT to have a restored threshold voltage Vth level.

Operation of the organic light emitting device 150 according to the sixth embodiment will be described in detail with reference to FIG. 15.

During a current programming interval T1, a supply voltage VDD is not supplied when a scan signal $Scan_n$ Signal is supplied to gates of the first and second switching TFTs ST1 and ST2 by the previous scan line 154.

During an output current supply interval T2, the scan signal $Scan_n$ Signal is not supplied, and the supply voltage VDD is supplied. Thus, a voltage generated due to a data current stored on the storage capacitor Cst drives the driving TFT DT to thereby supply an output current $I_{OLED}$ to the OLED.

During a negative bias voltage supply interval T3, when the previous scan signal $Scan_{n-1}$ Signal is supplied, the previous ground voltage $GND_{n-1}$ is not supplied and the ground voltage $GND_n$ is supplied. As a result, a negative bias voltage is supplied that is as much as a voltage difference (VSSL−VSSH) between the ground voltage $GND_n$ and the previous ground voltage $GND_{n-1}$ that is lower than the ground voltage $GND_n$.

The threshold voltage Vth may be restored using the previous scan line $Scan_{n-1}$ and the previous ground voltage $GND_{n-1}$ without additionally configuring the supporting scan line or the supporting data line.

Figure 16:
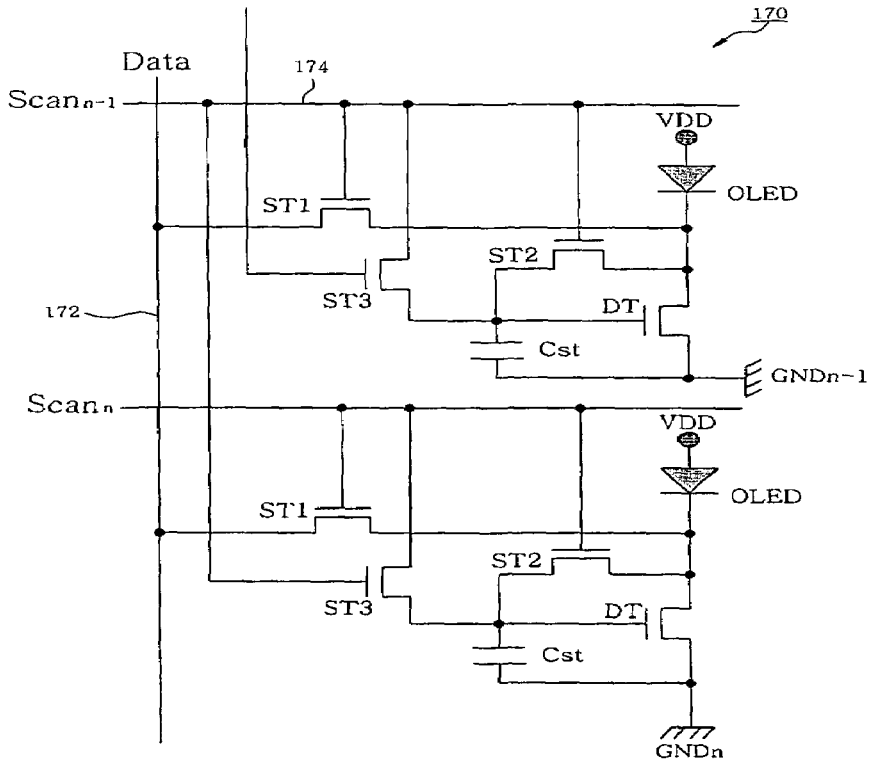
FIG. 16 illustrates an equivalent circuit diagram of an organic light emitting device in accordance with a seventh embodiment of the present invention.
Figure 17:
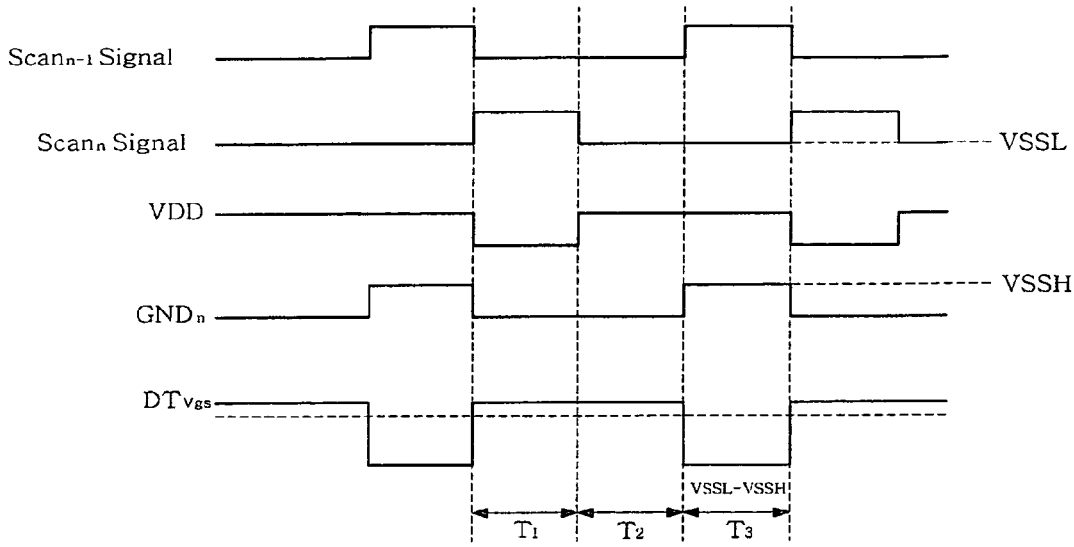
FIG. 17 illustrates a drive timing diagram of the organic light emitting device illustrated in FIG. 16.

FIG. 16 illustrates an equivalent circuit diagram of an organic light emitting device in accordance with a seventh embodiment of the present invention. FIG. 17 illustrates a drive timing diagram of the organic light emitting device illustrated in FIG. 16.

With reference to FIGS. 16 and 17, the organic light emitting device 170 includes a driving TFT DT, first and second switching TFTs ST1 and ST2, a storage capacitor Cst, an OLED, and a threshold voltage restorer ST3.

The threshold voltage restorer ST3 is connected between a gate of the driving TFT DT and a scan line $Scan_n$.

Particularly, a gate of the threshold voltage restorer ST3 is connected to a previous scan line 174 labeled as $Scan_{n-1}$, so that a previous scan signal that is supplied by the previous scan line 174 allows the driving TFT DT to have a restored threshold voltage Vth level.

Operation of the organic light emitting device 170 according to the seventh embodiment of the present invention will be described in detail with reference to FIG. 17.

During a current programming interval T1, a supply voltage VDD is not supplied when a scan signal $Scan_n$ Signal is supplied to gates of the first and second switching TFTs ST1 and ST2 by the previous scan line 174.

During an output current supply interval T2, the scan signal $Scan_n$ Signal is not supplied, and the supply voltage VDD is supplied. Thus, the driving TFT DT drives due to a voltage generated by a data current stored on the storage capacitor Cst. As a result, an output current $I_{OLED}$ is supplied to the OLED.

During a negative bias voltage supply interval T3, when the previous scan signal $Scan_{n-1}$ Signal is supplied, the scan signal $Scan_n$ Signal is not supplied and the ground voltage $GND_n$ is supplied. As a result, a negative bias voltage is supplied as much as a voltage difference (VSSL−VSSH) between the ground voltage $GND_n$ and a voltage of the scan signal $Scan_n$ Signal that is lower than the ground voltage $GND_n$.

As illustrated, the threshold voltage Vth may be restored using the precedent scan line $Scan_{n-1}$ and the scan line $Scan_n$ without the additional configuration of the supporting scan line and the supporting data line.

In the above exemplary embodiments of the present invention, the light emitting devices are organic light emitting devices comprising organic emissive layers.

Although it is described in the exemplary embodiments that the negative bias voltage is supplied to the driving TFT DT after the output current supply interval T2, the negative bias voltage may be supplied prior to the current programming interval T1 or during the output current supply terminal T2.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A light emitting device comprising:

a light emitting diode emitting light due to an output current;

a storage capacitor storing a data signal supplied by a data line;

a driving thin film transistor (TFT) connected between a supply voltage and the light emitting diode and having a gate connected to one end of the storage capacitor to supply the output current to the light emitting diode using the data signal stored in the storage capacitor;

an input switch connected between the one end of the storage capacitor and the data line and having a gate connected to a first scan line to transmit the data signal supplied by the data line in response to a first scan signal supplied by the first scan line; and a threshold voltage compensator connected between the gate and a drain of the driving TFT and having a gate connected to a second scan line to temporarily store at the storage capacitor a gate voltage reflecting a threshold voltage of the driving TFT in response to a second scan signal supplied by the second scan line and to transmit the data signal regardless of variations in the threshold voltage of the driving TFT when the output current is supplied to the light emitting diode.

2. A light emitting device comprising:

a light emitting diode emitting light due to an output current;

a storage capacitor storing a data signal supplied by a data line;

a driving thin film transistor (TFT) connected between a ground voltage and the light emitting diode and having a gate connected to one end of the storage capacitor to supply the output current to the light emitting diode using the data signal stored in the storage capacitor;

an input switch connected between the gate of the driving TFT and the data line and having a gate connected to a first scan line to transmit the data signal supplied by the data line in response to a first scan signal supplied by the first scan line; and a threshold voltage compensator connected between the gate and a drain of the driving TFT and having a gate connected to a second scan line to temporarily store at the storage capacitor a gate voltage reflecting a threshold voltage of the driving TFT in response to a second scan signal supplied by the second scan line and to transmit the data signal regardless of variations in the threshold voltage of the driving TFT when the output current is supplied to the light emitting diode.

3. The light emitting device of claim 1, wherein the driving TFT, the input switch and the threshold voltage compensator are P-channel metal oxide semiconductor (PMOS) transistors.

4. The light emitting device of claim 2, wherein the driving TFT, the input switch and the threshold voltage compensator are N-channel metal oxide semiconductor (NMOS) transistors.

5. The light emitting device of claim 1, wherein the first scan line and the second scan line are substantially the same line, and the first scan signal and the second scan signal are substantially the same signal.

6. The light emitting device of claim 2, wherein the first scan line and the second scan line are substantially the same line, and the first scan signal and the second scan signal are substantially the same signal.

7. The light emitting device of claim 1, wherein the data signal supplied by the data line is a static current, and when the first scan signal and the second scan signal are in an 'on' state, the data signal drives the driving TFT.

8. The light emitting device of claim 7, wherein the static current is supplied to the driving TFT when the first scan signal and the second scan signal are in an 'on' state.

9. The light emitting device of claim 2, wherein the data signal supplied by the data line is a static current, and when the first scan signal and the second scan signal are in an 'on' state, the data signal drives the driving TFT.

10. The light emitting device of claim 9, wherein the static current is supplied to the driving TFT when the first scan signal and the second scan signal are in an 'on' state.

11. The light emitting device of claim 6, further comprising:

a threshold voltage restorer connected to the gate of the driving TFT and supplying a gate voltage that is lower than the ground voltage.

12. The light emitting device of claim 11, wherein the threshold voltage restorer is connected between the gate of the driving TFT and a supporting data line and has a gate connected to a supporting scan line.

13. The light emitting device of claim 11, wherein the threshold voltage restorer is connected between the gate of the driving TFT and a ground voltage of a previous terminal and has a gate connected to a first scan line of the previous terminal.

14. The light emitting device of claim 11, wherein the threshold voltage restorer is connected between the gate of the driving TFT and the first scan line and has a gate connected to the first scan line of the previous terminal.

15. The light emitting device of claim 12, wherein the threshold voltage restorer is an NMOS transistor.

16. The light emitting device of claim 13, wherein the threshold voltage restorer is an NMOS transistor.

17. The light emitting device of claim 14, wherein the threshold voltage restorer is an NMOS transistor.

18. The light emitting device of claim 1, wherein the light emitting device comprises an organic emissive layer.

19. The light emitting device of claim 2, wherein the electroluminescence device comprises an organic emissive layer.

* * * * *